US006700506B1

(12) United States Patent
Winkler et al.

(10) Patent No.: US 6,700,506 B1
(45) Date of Patent: Mar. 2, 2004

(54) BUS ARRIVAL NOTIFICATION SYSTEM AND METHODS RELATED THERETO

(75) Inventors: Josef K. Winkler, Reading, PA (US); Vernon L. Stant, Richmond, VA (US); Stephen G. Wilson, Charlottessville, VA (US)

(73) Assignee: Everyday Wireless, Inc., West Lawn, PA (US)

( * ) Notice: Subject to any disclaimer, the term of this patent is extended or adjusted under 35 U.S.C. 154(b) by 0 days.

(21) Appl. No.: 09/661,746

(22) Filed: Sep. 14, 2000

(51) Int. Cl.[7] ..... G08G 1/123
(52) U.S. Cl. ..... 340/994; 340/989; 701/204
(58) Field of Search ..... 340/994, 993, 340/989, 991, 990, 539, 988; 701/204, 200, 213

(56) References Cited

U.S. PATENT DOCUMENTS

| | | | | |
|---|---|---|---|---|
| 3,860,872 A | * | 1/1975 | Richardson | 325/304 |
| 4,325,057 A | | 4/1982 | Bishop | 340/539 |
| 4,350,969 A | * | 9/1982 | Greer | 340/994 |
| 5,021,780 A | | 6/1991 | Fabiano et al. | 340/994 |
| 5,144,301 A | | 9/1992 | Jackson et al. | 340/994 |
| 5,400,020 A | | 3/1995 | Jones et al. | 340/994 |
| 5,592,383 A | * | 1/1997 | Rogers | 33/286 |
| 5,680,119 A | | 10/1997 | Magliari et al. | 340/904 |
| 5,987,377 A | * | 11/1999 | Westerlage | 340/994 |
| 6,006,159 A | | 12/1999 | Schmier et al. | 701/200 |
| 6,124,810 A | * | 9/2000 | Segal | 340/994 |

FOREIGN PATENT DOCUMENTS

| | | |
|---|---|---|
| WO | WO 97/17685 | 5/1997 |
| WO | WO 99/52091 | 10/1999 |

* cited by examiner

*Primary Examiner*—Anh V La
(74) *Attorney, Agent, or Firm*—Peter F. Coreless; William J. Daley, Jr.; Edwards & Angell, LLP

(57) ABSTRACT

The present invention relates to a system and methods for notifying passengers of an approaching vehicle. Utilizing this invention, passengers can remain in a safe, controlled environment, avoiding harsh environmental conditions and excessive waiting times, instead arriving at their pick-up point just prior to a vehicle's arrival. More specifically, the present invention relates to a bus notification system wherein passengers are able know the precise location and arrival time of the transporting vehicle several minutes before its arrival at a specified location along the vehicle route.

32 Claims, 6 Drawing Sheets

FIG. 1
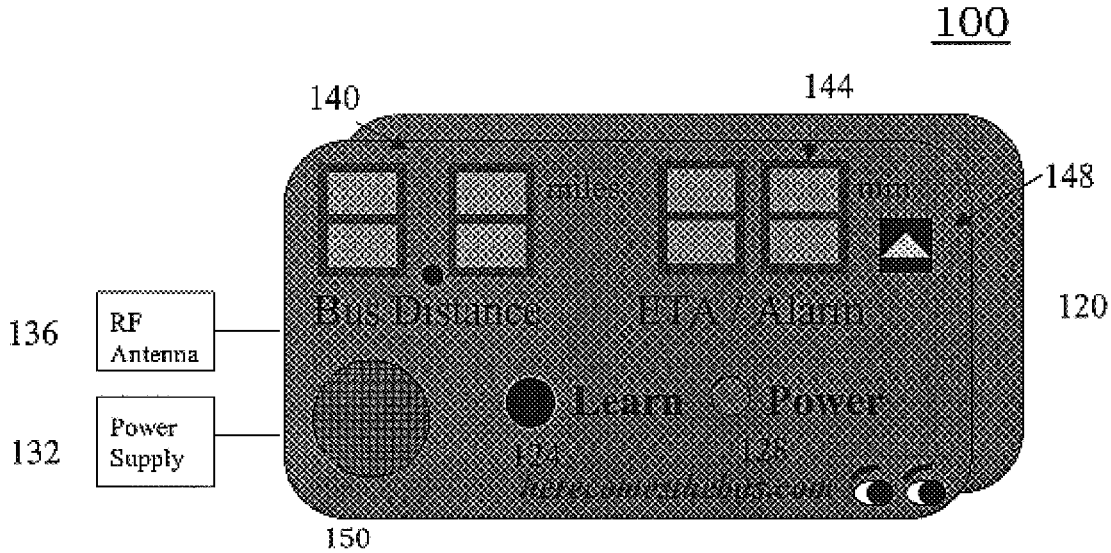
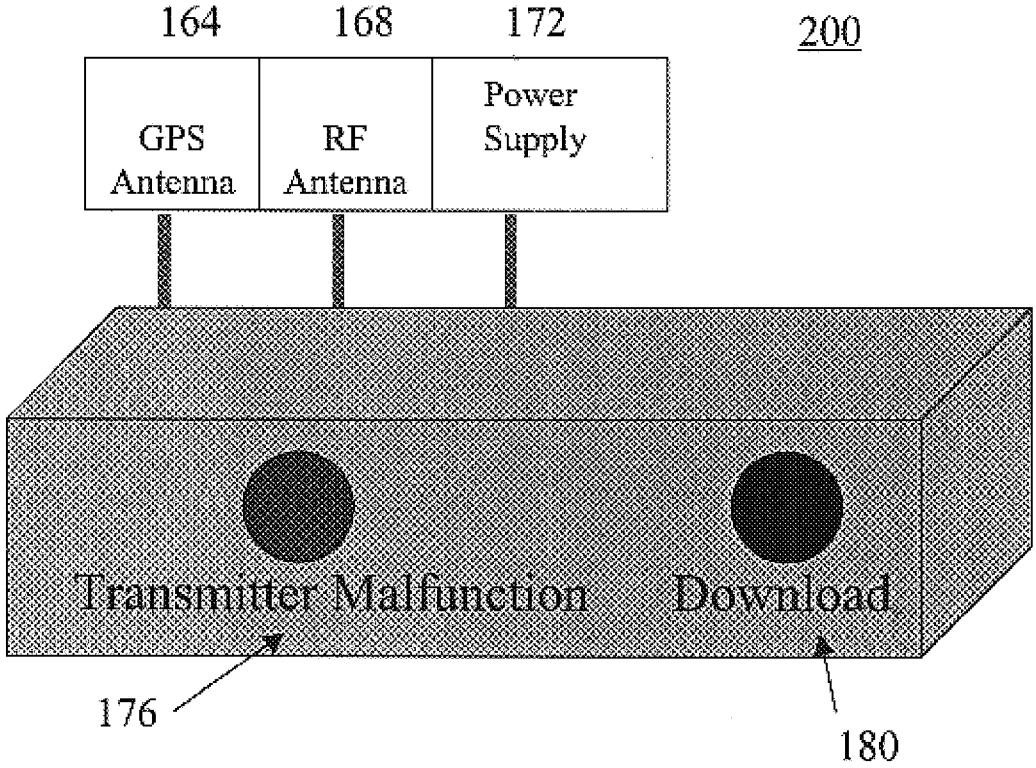

FIG. 4

Stored Receiver Log File

| Time | Latitude | Longitude | Direction |
|---|---|---|---|
| 7:32:00 | Lat. 1 | Long. 1 | Direc. 1 |
| 7:32:15 | Lat. 2 | Long. 2 | Direc. 2 |
| 7:32:30 | Lat. 3 | Long. 3 | Direc. 3 |
| 7:32:45 | Lat. 4 | Long. 4 | Direc. 4 |
| 7:33:00 | Lat. 5 | Long. 5 | Direc. 5 |
| 7:33:15 | Lat. 6 | Long. 6 | Direc. 6 |
| 7:33:30 | Lat. 7 | Long. 7 | Direc. 7 |
| 7:33:45 | Lat. 8 | Long. 8 | Direc. 8 |
| 7:34:00 | Lat. 9 | Long. 9 | Direc. 9 |
| 7:34:15 | Lat. 10 | Long. 10 | Direc. 10 |
| 7:34:30 | Lat. 11 | Long. 11 | Direc. 11 |
| 7:34:45 | Lat. 12 | Long. 12 | Direc. 12 |
| 7:35:00 | Lat. 13 | Long. 13 | Direc. 13 |
| 7:35:15 | Lat. 14 | Long. 14 | Direc. 14 |
| 7:35:30 | Lat. 15 | Long. 15 | Direc. 15 |
| 7:35:45 | Lat. 16 | Long. 16 | Direc. 16 |
| 7:36:00 | Lat. 17 | Long. 17 | Direc. 17 |
| 7:36:15 | Lat. 18 | Long. 18 | Direc. 18 |
| 7:36:30 | Lat. 19 | Long. 19 | Direc. 19 |
| 7:36:45 | Lat. 20 | Long. 20 | Direc. 20 |
| 7:37:00 | Lat. 21 | Long. 21 | Direc. 21 |
| 7:37:15 | Lat. 22 | Long. 22 | Direc. 22 |
| 7:37:30 | Lat. 23 | Long. 23 | Direc. 23 |
| 7:37:45 | Lat. 24 | Long. 24 | Direc. 24 |
| 7:38:00 | Lat. 25 | Long. 25 | Direc. 25 |
| 7:38:15 | Lat. 26 | Long. 26 | Direc. 26 |
| 7:38:30 | Lat. 27 | Long. 27 | Direc. 27 |
| 7:38:45 | Lat. 28 | Long. 28 | Direc. 28 |
| 7:39:00 | Lat. 29 | Long. 29 | Direc. 29 |
| 7:39:15 | Lat. 30 | Long. 30 | Direc. 30 |
| 7:39:30 | Lat. 31 | Long. 31 | Direc. 31 |
| 7:39:45 | Lat. 32 | Long. 32 | Direc. 32 |
| 7:40:00 | Lat. 33 | Long. 33 | Direc. 33 |
| 7:40:15 | Lat. 34 | Long. 34 | Direc. 34 |
| 7:40:30 | Lat. 35 | Long. 35 | Direc. 35 |
| 7:40:45 | Lat. 36 | Long. 36 | Direc. 36 |
| 7:41:00 | Lat. 37 | Long. 37 | Direc. 37 |
| 7:41:15 | Lat. 38 | Long. 38 | Direc. 38 |
| 7:41:30 | Lat. 39 | Long. 39 | Direc. 39 |
| 7:41:45 | Lat. 40 | Long. 40 | Direc. 40 |
| 7:42:00 | Lat. 41 | Long. 41 | Direc. 41 |
| 7:42:15 | Lat. 42 | Long. 42 | Direc. 42 |
| 7:42:30 | Lat. 43 | Long. 43 | Direc. 43 |
| 7:42:45 | Lat. 44 | Long. 44 | Direc. 44 |
| 7:43:00 | Lat. 45 | Long. 45 | Direc. 45 |
| 7:43:15 | Lat. 46 | Long. 46 | Direc. 46 |
| 7:43:30 | Lat. 47 | Long. 47 | Direc. 47 |
| 7:43:45 | Lat. 48 | Long. 48 | Direc. 48 |

User sets advance time warning to be 10 minutes.
Receiver look backs 10 minutes in its log file.
When bus location = Lat. 5, Long. 5, Direc. 5, alarm activates.

Learn function activated 
 Signal strength maximized -- store this as actual bus stop

FIG. 6
Bus Track
Bus Route: 25
Date: 9/23/00
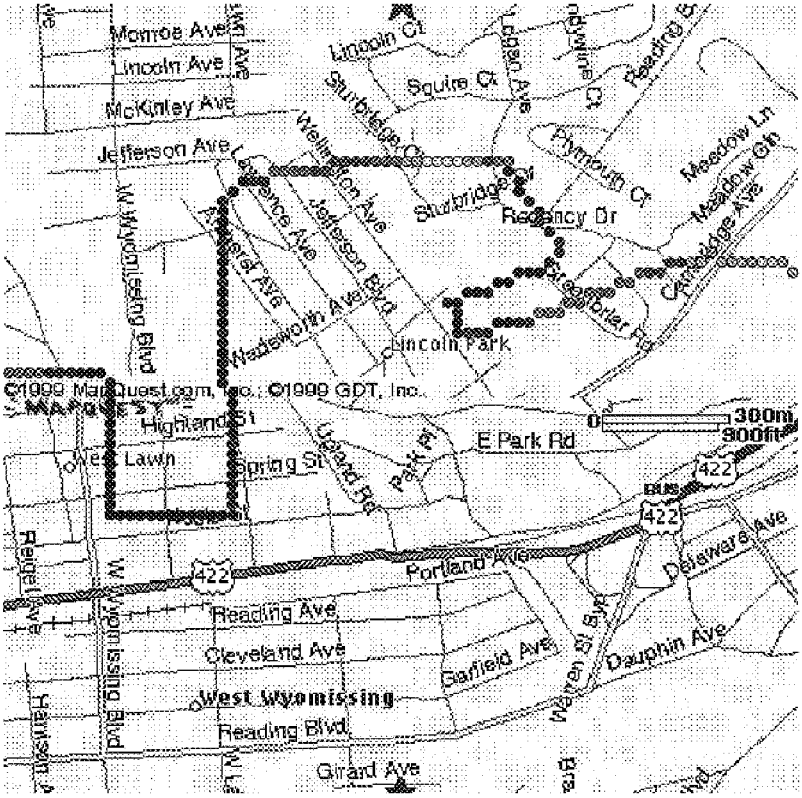
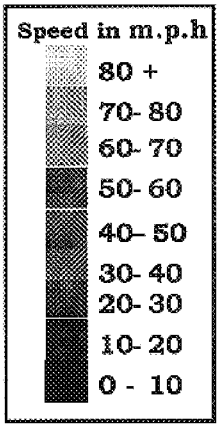
142714

BUS ARRIVAL NOTIFICATION SYSTEM AND METHODS RELATED THERETO

BACKGROUND OF THE INVENTION

1. Field of the Invention

The present invention relates to a system and methods for notifying passengers of an approaching vehicle. Utilizing this invention, passengers can remain in a safe, controlled environment, avoiding harsh environmental conditions and excessive waiting times, instead arriving at their pick-up point just prior to a vehicle's arrival. More specifically, the present invention relates to a bus notification system that will provide a passenger with adequate warning of an approaching bus well in advance of its arrival at the bus stop.

2. Background Art

In many cities and towns, school systems are required to provide transportation to and from school for children living more than a specified distance from school. Generally this transportation is in the form of busing whereby school buses pick up school children at several bus stops along several bus routes and then deliver the children to their school. The arrival time of a school bus at a given bus stop can vary significantly from day to day for any of a number of reasons. As a result, children typically arrive at the bus stop well before the bus is expected to arrive to avoid missing the bus. These children frequently lack parental supervision. Furthermore, on inclement weather days, children waiting for their bus are exposed to harsh weather conditions including rain, snow, or extreme cold. To avoid this situation, concerned parents frequently wait with their children at the bus stop in a car, causing unnecessary pollution.

Buses can be delayed for numerous reasons including inclement weather, such as fog, snow, ice or extreme cold, which reduces the speed of the bus and thus impedes the arrival of the bus at the planned time. Similarly, bus mechanical problems, heavy traffic or substitute bus drivers can generate lengthy delays in bus arrival time. In addition, many school buses will make several sequential runs to pickup children for different schools such as the high, middle and grade schools for a town. A delay in picking up children in the first run can result in similar or longer delays for subsequent runs. Correspondingly, it is possible, when there is good weather and light traffic conditions, for the bus to arrive at the bus stop earlier than the planned time.

In areas where bus routes cover many miles there frequently is a large variance in arrival time of a bus at the bus stops along the route and in many instances the bus stop will not be visible from the home. Similarly in areas where children live closer together, frequently there are communal bus stops for several children such that the bus stop is not visible from the home of each child. Advance notification of bus arrival also allows time to prepare the children for school without rushing to catch the bus.

There are many other situations where passengers and their families might find advance bus notification information useful. Children with special needs will especially benefit from such information, as they will have adequate warning time by which to prepare for boarding of the bus. Additionally, all passengers will be relieved of the shock factor of a bus pulling up unannounced.

There is disclosed in U.S. Pat. No. 4,325,057 a bus notification system wherein each bus transmitter emits a signal at a unique radio frequency to identify a specific bus. Each receiver is then tuned to the frequency corresponding to said bus transmitter and the length of time between notification and bus arrival is determined by adjusting the receiver's sensitivity control. When the receiver acquires the bus transmission above the predetermined sensitivity threshold the notification system is activated.

Similarly, there is disclosed in U.S. Pat. No. 5,144,301 an alert system using different radio frequencies to identify particular buses and receivers that are tuned to the appropriate radio frequency wherein the time to bus arrival is approximated by comparing the received signal strength to an adjustable threshold setting. When the received signal strength exceeds the threshold, the receiver sequentially activates visual and audio warning signals.

In U.S. Pat. No. 5,021,780, there is disclosed an arrival notification where each bus emits an encoded signal uniquely identifying the bus and receivers in homes along the route are adjusted prior to distribution to receive only the encoded signal transmitted by the bus. The alerting mechanism in the receiver is activated upon detection of the encoded bus transmission using signal strength to estimate arrival time. However, the receiver does not incorporate a method for adjusting the alerting mechanism sensitivity. As a result, there is no available means to control the delay time between notification and bus arrival. Additionally, since the receivers in homes are adjusted prior to distribution, any bus changes or household moves to new buses introduces additional logistics problems.

In these disclosures, the time to bus arrival is approximated by the strength of the bus transmission signal received at the household. Signal strength, however, may not be an accurate measure of distance in every case because obstructions in the wireless radio frequency path can further reduce the signal strength thereby tricking the distance calculation by the receiver. The reduced signal strength can significantly reduce the time period between notification of bus arrival and the actual arrival of said bus. In addition, if the bus route includes several streets that are in close proximity requiring the bus to double back to cover said streets; the possibility for premature notification arises. Further, if two adjacent school districts use the same radio frequency, false alarms and premature notifications can result from two buses in neighboring districts broadcasting the same radio frequency.

A complex advance notification system for alerting passengers when a vehicle is ahead of or behind schedule is disclosed in U.S. Pat. No. 5,400,020. In this system, a vehicle control unit compares the actual time at which the vehicle reaches a predetermined location along the vehicle route against the scheduled arrival time, where the vehicle location is determined by global positioning system (GPS) technology. If there is a discrepancy between the actual and scheduled time values, the vehicle control unit relays the time discrepancy to a base station control unit by wireless communication. The base station control unit notifies each passenger of the change in arrival time by telephone. Thus, arrival time notification only occurs if the vehicle is off schedule. Further, the notification system requires that the telephone line be open and a person present to receive the telephone call. If the passenger is unable to hear the telephone ring such as when the phone is already in use or when the passenger is outside awaiting the arrival of the vehicle, the notification system will fail.

Another complex system for notifying passengers waiting for public transit vehicles of the status of transit vehicles, including expected arrival times of vehicles at transit stops and arrival of connecting transit vehicles is disclosed in U.S. Pat. No. 6,006,159. The disclosed system determines the location of transit vehicles by using a GPS device. The vehicle location is transmitted to a central facility wherein the central processor generates a master transit table for all vehicles calculating scheduled stops, connections to other transit vehicles and arrival times at each scheduled stop. The master transit table is subsequently broadcast to display devices located throughout the geographic area of the transit system including display devices in vehicles and transit stops. The display device stores the transit table or a subset thereof and displays selected information. In addition, the transit table or a subset thereof can be received by portable display means such as pagers, computers or telephones.

This transit notification system is appropriate for city or regional public transportation systems where the system involves a large number of passengers who are traveling between any two transit stops within the transit system and a large number of transit vehicles which are traveling on numerous transit routes within a large geographic area. The central facility must have sufficient resources to process a continuous data feed from each vehicle in the system to form updated transit tables and broadcast the transit table over the entire geographic area of the transit system. This system of notification requires a significant investment of resources in infrastructure development including installation of the central processing center, smart display devices throughout the transit system and vehicle information units in the transit vehicles.

Many passengers predominantly use a transit system to travel between two points such as a commute between home and work. The portable display devices disclosed in this patent are capable of displaying arrival information for a vehicle at a selected vehicle stop, but they can not alert a passenger that a vehicle will arrive at said vehicle stop within a predetermined period of time. Frequently, an automated notification process is desirable to alert the passenger that it is time to start the commute. A device capable of alerting such a commuter of the exact time by which to leave for their commute prior to leaving their controlled environment would be ideal.

In U.S. Pat. No. 5,680,119, there is described a vehicle identification system wherein types of vehicles such as emergency, school bus or other public transportation, delivery or service vehicles with emitters transmit an identifiable signal corresponding to the vehicle type. This patent does not describe a method for identifying a unique vehicle of a particular class, but rather only a method for determining the type of vehicle. Thus, the system merely differentiates between a school bus and an ambulance.

A receiving unit acquiring a RF signal broadcast from a nearby vehicle containing the correct information that is not actually picking up passengers can incorrectly notify passengers of a vehicle arrival at a specified point along the vehicle route. For example, one common passenger pickup technique is to drive all the way to the end of a vehicle route and then commence picking up passengers from the end of the route. This pickup technique poses problems for passengers near the beginning of the route, who are passed by the vehicle traveling in the wrong direction a considerable time before their vehicle actually stops to pick them up. In another example, public transportation vehicles frequently stop at each station in both directions along the vehicle route. Incorporation of a direction of travel parameter into the information transmitted from a vehicle would be especially valuable, allowing a receiving unit to only activate an alert mechanism when receiving a transmission from the correct vehicle traveling in a specified direction.

It thus would be desirable to provide a notification system that can more accurately predict a precise time of vehicle arrival such that a passenger's waiting time for the vehicle is minimized. Such a notification system also should be less complex, less costly and not require extensive infrastructure as compared to prior art systems. Additionally, such systems and particularly the receivers therefor should be inexpensive and not require highly trained individuals to operate the equipment.

SUMMARY OF THE INVENTION

The present invention features a vehicle arrival notification system that will enable passengers to know the precise location and arrival time of the transporting vehicle several minutes before its arrival. The notification system comprises a transmission apparatus on a vehicle and receiving units at various locations along the vehicle route such as businesses, households, schools and the like. The transmission apparatus includes subsystems for determining the exact location of the bus and transmitting a signal including information identifying the vehicle route and the current vehicle location. The receiving unit compares the current vehicle location and direction of travel with information stored in its vehicle arrival log, thereby determining the time until the arrival of the vehicle at the specified location along the vehicle route. The alert function, either audio or visual, is activated when the receiving unit determined vehicle arrival time is less than an adjustable time threshold set by the passenger. The alarm function can also work off of a distance threshold, wherein the passenger sets an adjustable distance trigger to activate the alarm, the receiving unit determines the distance between the vehicle and the receiving unit with a simple distance calculation and the alarm is triggered when the calculated distance is less than the threshold.

In a preferred application of such a notification system, children and their parents are alerted to the approach of a school bus to pick up the children at a school bus stop. The accurate notification of an approaching school bus can minimize if not significantly eliminate the children's wait at the bus stop and consequently their exposure to inclement weather. Children can spend a few extra minutes inside their home with their parents instead of enduring lengthy waits at the bus stop in potentially adverse conditions. In addition to notifying households of an approaching bus picking children up to go to school, the receiver will also alert parents of an approaching school bus dropping children off at the end of the school day.

The system includes the means to accurately determine the location of the vehicle and the location of any specified vehicle stop so that the distance between the vehicle and the vehicle stop and the corresponding time can be accurately measured. Global positioning satellite (GPS) technology generates extremely accurate location coordinates by analysis of signals from a plurality of global positioning satellites. Receiving units within the range of the transmission apparatus' RF signal receive the GPS determined location of the vehicle regardless of the strength of the RF signal and calculate the distance between the vehicle and the vehicle stop using GPS determined locations for both the vehicle and the vehicle stop. Unlike systems relying on signal strength to determine the distance that are subject to inaccuracies resulting from obstructions in the wireless radio frequency path, the vehicle location as determined by GPS is independent of signal strength. As a result, a receiving unit can accurately calculate an associated arrival time and the distance between receiving unit and vehicle, thereby providing accurate arrival information.

In specific embodiments, the system further includes the means to determine if an approaching vehicle is traveling in a specified direction so that passengers are only notified when a vehicle is approaching a vehicle stop from a specified direction. The transmission apparatus further includes the means to determine the direction of vehicle travel by GPS technology and transmit a signal further including information about the a direction of vehicle travel. Each receiving unit further compares the received direction of vehicle travel with a specified direction of vehicle travel such that an alarm function is activated when the vehicle is closer than a specified threshold location and traveling in the specified direction.

In preferred embodiments of the invention, the receiving unit further includes the means to acquire information about a vehicle by a simple information acquisition protocol herein referred to as the learn function. Activating the learn function when a vehicle approaches the vehicle stop causes the receiving unit to acquire the vehicle route number and direction of vehicle travel from the vehicle transmission unit signal. The receiving unit location coordinates are also acquired by the receiving unit from the bus transmission unit signal. After the learn function has been activated, the receiver listens for the transmission signal of greatest amplitude. When signal amplitude is maximized and distance between the transmitter and receiver is minimized, the bus stop location is stored into the receiver memory. Alternatively, the bus stop location can be simply stored into the receiver memory when the learn button is depressed.

Additional information is also transmitted from the transmitter to the receiver at this time. More specifically, a historical log file that includes vehicle location and direction of travel for at least one time entry is stored into the receiver's memory so that this data can be later accessed to understand exactly how the bus approached the bus stop. Preferably, the historical log file includes at least five minutes of time entries wherein sequential time entries are separated by a small time increment such as 10–30 seconds. As a result, the vehicle information acquired by the receiving unit during the learn function is used by the notification system to determine when to alert passengers that their specific vehicle is approaching.

In another embodiment of the present invention, the transmission apparatus further includes the means to electronically store information about the vehicle during operation. A vehicle log file is generated including an entry for each transmitted RF signal such that each entry includes a time mark and the transmitted vehicle location coordinates. Each vehicle log file entry can further include additional information such as vehicle speed and/or direction of vehicle travel. Information stored in a vehicle log file can be downloaded to a PC for use in monitoring vehicle operation. The information contained in the vehicle log files can be used to monitor vehicle operator performance and to determine the validity of passenger complaints regarding vehicle operation.

In a preferred embodiment of the present invention, the system includes a transmission apparatus that can be programmed with new vehicle information and to download information stored in a vehicle log file. A transmitter pendant interfaces with a transmission apparatus such that the pendant can display current transmission apparatus information and introduce new information. The transmitter pendant can further include an apparatus to download information stored in the vehicle log file of the transmission apparatus and transfer this information to a PC.

BRIEF DESCRIPTION OF THE DRAWINGS

For a fuller understanding of the nature and desired objects of the present invention, reference is made to the following detailed description taken in conjunction with the accompanying drawing figures wherein like reference character denote corresponding parts throughout the several views and wherein:

FIG. 1 is a schematic diagram of the notification system, 100, that includes a transmission apparatus 160 and at least one receiving unit 120.

FIG. 4 is an example of a historical log file stored in receiving unit memory and the receiving unit protocol for determining when to activate the alarm.

FIG. 6 is an example of a vehicle track plot where the vehicle route is indicated by circles and vehicle speed indicated by the circle shading.

DETAILED DESCRIPTION OF THE INVENTION

Figure 2:
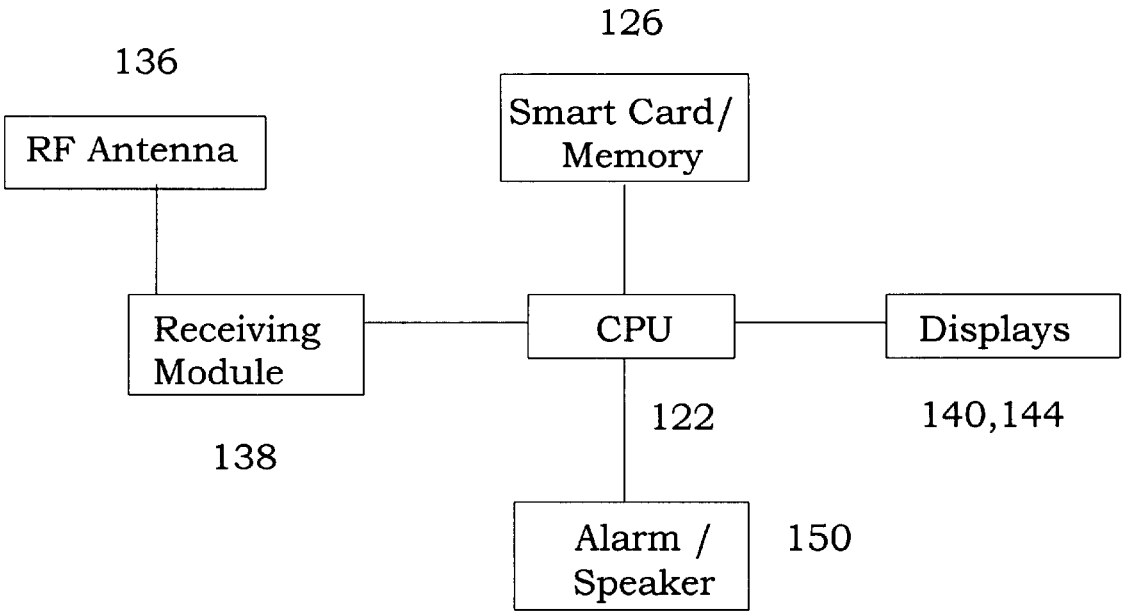
FIG. 2 is a block diagram of a receiving unit 120 components.

Turning now to the drawings, where like components are designated by the like reference numerals, FIG. 1 schematically illustrates one preferred embodiment 100 of a vehicle arrival notification system in accordance with the present invention. Here, a transmission apparatus 160 is located in a vehicle and receiving units 120 are located along the vehicle route in, for example, households and schools, to alert of an approaching vehicle in advance of its arrival at a specified point on the vehicle route.

Figure 3:
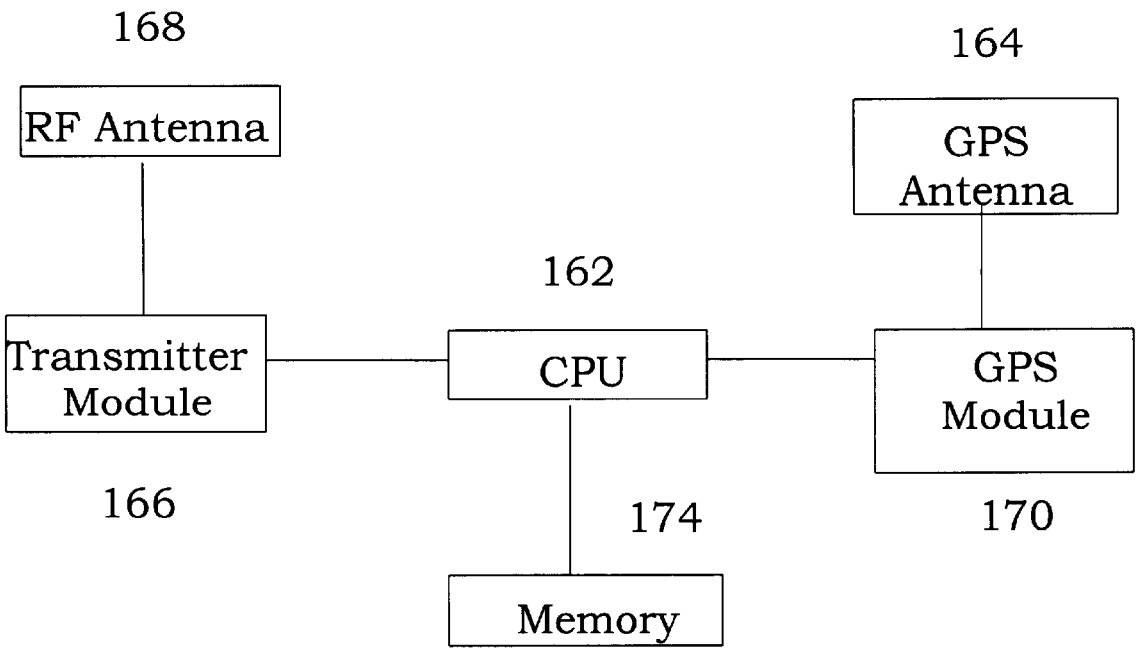
FIG. 3 is a block diagram of the transmitter apparatus 160 components.
Figure 5:
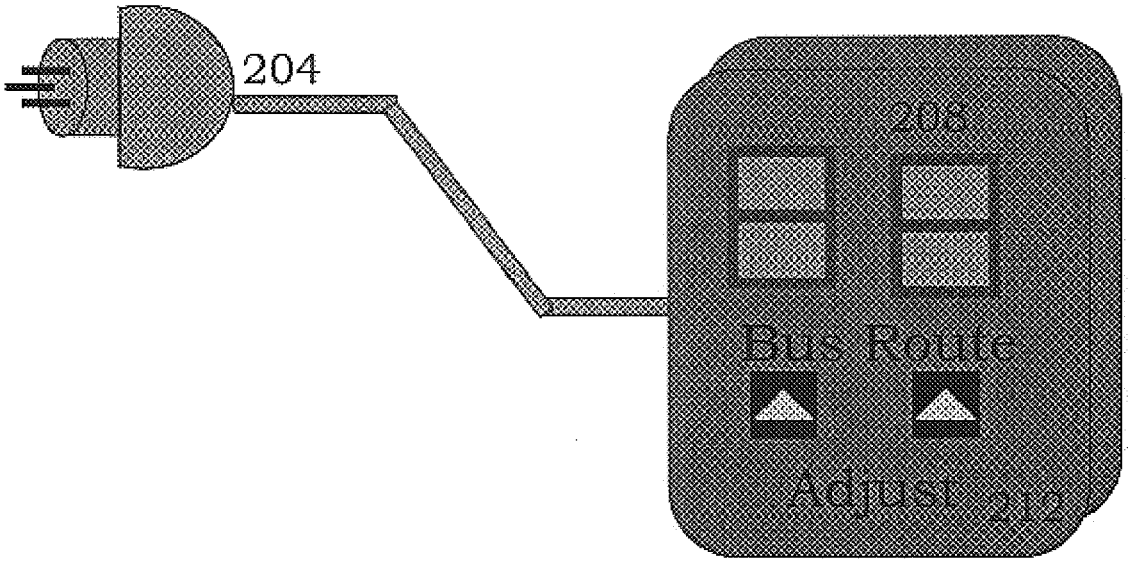
FIG. 5 is a schematic diagram of a transmitter pendant 200.

The transmission apparatus 160 determines the vehicle location and transmits a RF signal that includes vehicle identification and location information. Referring now to FIG. 3, and as indicated elsewhere herein, the transmission apparatus 160 has located therein a global positioning system (GPS) device 170 that receives signals from a plurality of global positioning satellites through a GPS antenna 164 and can determine vehicle location at any time from the received satellite information. Information about vehicle location is communicated to the transmission apparatus central processing unit (CPU) 162 from the GPS device 170.

The transmission apparatus CPU 162 preferably has the ability to execute and control transmission apparatus protocols and tasks. The CPU receives vehicle location information from the GPS device 170 and vehicle identification information from transmission apparatus memory means 174 and generates a signal that includes vehicle identification information and vehicle location.

The transmission apparatus 160 preferably further includes a transmission module 166 that generates a RF signal from the signal created by the microprocessor. The transmission module broadcasts the RF signal from RF antenna 168 over at least one radio frequency. Preferably, the RF signal is transmitted over a plurality of radio frequencies using channel hopping technology such that the transmission apparatus achieves maximal signal transmission range. The transmission apparatus CPU 162 has the means to monitor transmission module activity such that if the transmission module 166 fails to broadcast a RF signal, then the CPU activates a transmitter malfunction warning light 176.

The transmission module 166 processes the transmission signal generated by the CPU and transmits a RF signal. Preferably, Spread Spectrum technology with channel hopping is used to transmit the RF signal. As is well known in the art channel hopping maximizes effective signal range by providing maximal power while adhering to FCC Part 15 specifications. Preferably the number of channels used in channel hopping signal transmission is at least 25. More preferably the number of channels used in channel hopping signal transmission is at least 50. Complying with FCC Part 15 specifications, preferable transmissions are at 1 watt time intervals not to occupy a channel in excess of 0.4 seconds within a 10 second period. Additionally, bandwidth is minimized to maximize range wherein the frequency hopping systems shall have hopping channel carrier frequencies separated by a minimum of 25 kHz or the 20 dB bandwidth of the hopping channel, whichever is greater. A transmission apparatus will transmit vehicle information in packets of between 32 and 256 bits including vehicle identification information, vehicle location coordinates and when directional shielding is employed, direction of vehicle travel. The data transmission rate is at least 100 bps to generate a short transmission cycle. Preferably, the data transmission rate is at least 300 bps. For example, at 300 bps: 50 channels×32 bits/300 bps=5.3 seconds with a 5 to 10 second delay results in a 10–15 second transmission cycle.

The transmission apparatus 160 also includes a memory system 174 wherein vehicle identification information including, but not limited to vehicle route number and district information are stored electronically. The transmission apparatus memory means 174 can further store a vehicle log file wherein the log file includes a plurality of time-marked entries. The transmission apparatus CPU 162 has the means to generate log file entries such that each entry includes a time stamp recorded from a transmission apparatus clock and GPS determined vehicle location coordinates. Additional data parameters such as the direction of vehicle travel and vehicle speed can also be incorporated into a vehicle log file as necessary for specific applications. The transmission apparatus CPU 162 generates log entries on a conveniently short time-interval such as the periodicity of transmission apparatus RF signal broadcast.

In a preferred embodiment, the RF signal broadcast by the vehicle transmission apparatus 160 includes vehicle identification information and a historical log. The transmission apparatus CPU 162 includes the means to access the vehicle log file stored in the transmission apparatus memory means 174 and to generate from the vehicle log file a historical log file including at least 5 minutes of the most recent vehicle log file time entries. Preferably the historical log file includes at least 10 minutes of the most recent vehicle log file time entries. The transmission apparatus 160 as above described broadcasts a RF signal comprising vehicle identification information and the historical log file generated by the transmission apparatus CPU.

Now referring to FIG. 2, and as indicated elsewhere herein, receiving units 120 located along a vehicle route receive signals from at least one vehicle transmission apparatus within broadcast range and alert passengers when the correct vehicle is closer than a specified threshold location or distance. The receiving unit 120 includes a receiving module 138 and a RF antenna 136 such that the receiving module channel hops intelligently to receive RF signals broadcast by nearby vehicle transmission apparatus 160.

The receiving unit 120 further includes a CPU 122 wherein the CPU is in communication with the receiving module 138 such that the CPU receives RF signals from the receiving module. The receiving unit CPU 122 has the means to determine vehicle identification information and vehicle location from a received RF signal. Further, the CPU has the means to compare vehicle identification information included in the RF signal to identification information for the correct vehicle stored in receiving unit memory 126. The receiving unit CPU 122 further has the means to compare transmitted location information for the correct vehicle with its stored historical log files to determine the appropriate vehicle location by which to activate an audio or visual alert mechanism such as an audio speaker 150 and give the user adequate time by which to meet the vehicle at the bus stop. Alternatively, the receiving unit 120 has the means to identify the RF signal for the correct vehicle, calculate the distance between the GPS determined locations of the correct vehicle and the receiving unit such that the receiving unit CPU compares the calculated distance with a specified threshold distance and activates an audio or visual alert mechanism such as an audio speaker 150 when the calculated distance is less than the threshold distance.

The receiving unit 120 includes a vehicle display 140 for displaying of the calculated distance between the receiving unit and the correct vehicle or the calculated time to vehicle arrival wherein the distance or time is displayed in a convenient unit of measure such as miles or minutes respectfully. Additionally, the threshold distance or arrival time threshold can be adjusted by a threshold control mechanism 148 wherein non-limiting examples of threshold adjustment mechanisms are a switch, button or dial. The specified threshold entered using the threshold control mechanism 148 is displayed in a threshold display 144 wherein an arrival time threshold is displayed in minutes and a distance threshold is displayed in miles. In the normal run mode, when the threshold adjustment is not being adjusted, calculated bus distance and an estimated time to arrival are both displayed.

The receiving unit 120 includes a memory means 126 wherein are stored the GPS determined receiving unit location, specified threshold time or distance, a historical log file and vehicle identification information for the vehicle for whose arrival passengers are to be notified. Preferably the receiving unit memory means 126 is an inexpensive memory storage device that can be manufactured with a limited service life. More preferably the receiving unit memory means 126 is a Smart Card with a one year renewable service life such that consumers are required to resubscribe to maintain receiving unit operation.

The receiving unit 120 also includes a learn function wherein the learn function includes the means for acquiring information about a specified vehicle. Actuating the learn button or switch 124 when the correct vehicle is approaching a specified vehicle stop causes the receiving unit CPU 122 to acquire vehicle identification information from the strongest received RF signal and to store this vehicle identification information in the receiving unit memory means. The receiving unit CPU further includes the means to monitor the vehicle location in the learn function whereby the GPS determined vehicle location is stored in the receiving unit memory means as signal amplitude is maximized and distance between the transmitter and receiver is minimized.

In an alternate methodology, the receiving unit 120 learn acquires the receiving unit location coordinates, bus route number and direction of bus travel from the bus transmitter signal. As the bus approaches the bus stop on the first day of school, a parent or child waiting at the bus stop activates the receiving unit 120 learn function. The receiver captures the bus route number the direction of travel from the bus transmitter signal. Deactivating the learn function button after the bus has stopped at the bus stop captures the bus location coordinates whereby the bus location coordinates are stored in receiving unit memory 126 as the receiving unit location.

In a specific embodiment of the present invention, the system 100 further provides a directional shield to increase the notification accuracy for vehicle arrival. The vehicle transmission apparatus GPS device 170 further includes the means to determine the direction of vehicle travel. The transmission apparatus CPU 162 further incorporates the direction of travel into the RF signal broadcast by the transmission apparatus 160 whereby a receiving unit 120 further compares the received direction of vehicle travel against a specified direction of vehicle travel stored in the receiving unit memory means 126 during activation of the learn function. Preferably, the direction of vehicle travel is expressed in degrees, the standard NMEA directional output from the GPS device 170. However, any other method for reporting the direction of vehicle travel is also acceptable. The activation of an alert mechanism by a receiving unit 120 is additionally dependent upon the received direction of vehicle travel being coincident with the stored direction of vehicle travel. By incorporating a direction of travel parameter into the information included in the transmitted RF signal from a bus, the receiving unit alert mechanism is triggered only when receiving a transmission from a bus with the correct bus route number traveling in the correct direction located within a specified distance threshold.

Referring now to FIG. 2, and as indicated elsewhere herein, the system can further include a transmission pendant 200 wherein the transmission pendant 200 connects to a transmission apparatus download port 180 via an interface 204. The transmission pendant 200 includes a display 208 whereby current vehicle identification information stored in the transmitter apparatus memory means is viewable. The pendant 200 further includes the means to change or modify vehicle identification information that is transmitted from a particular transmission apparatus 160. Additionally, the pendant 200 contains a memory means for electronically storing the contents of at least one transmission apparatus vehicle log file and the means to download the contents of a vehicle log file from a transmission apparatus 160. Further the transmission pendant 200 will include a standardized PC connection such as an RS-232 connection for transferring downloaded transmission apparatus data to a PC. There are sufficient adjustment controls 212 to efficiently enter vehicle identification information modifications and to effect download of vehicle log file data from the transmission apparatus to the connected pendant.

While a pendant 200 is disclosed as the preferred embodiment, others comparable transmission apparatus 160 not requiring a pendant 200 could be easily constructed. For instance, route information adjustments could be mounted directly to the transmission apparatus 160. Utilizing the transmitter's transmission capabilities, bus information could be uploaded directly to a PC wirelessly, eliminating the need for a pendant 200.

In a preferred embodiment, a pendant 200 is utilized to minimize costs by eliminating many of the transmission apparatus adjustments and displays. The transmission pendant 200 can be any device that can interface with bus transmission apparatus 160, has an input device 212 to modify the bus transmission apparatus parameters or execute a bus log file capture, and has an interface 204 capable of connecting to a PC to facilitate data transfer. Preferably the transmission pendant 200 is a modified handheld electronic personal organizer, such as a Palm Pilot, with the necessary interface ports and software to comply with the above stated requirements.

Now referring to FIG. 6, and as indicated elsewhere herein, in a specific embodiment of the present invention, vehicle log files downloaded from the vehicle transmission apparatus to a PC include data on where the corresponding vehicle has been and the speed of the vehicle along its route. The PC includes the means to process the information included in a vehicle log file to generate a corresponding vehicle track plot wherein the location and speed of the bus at each vehicle log file entry is transferred to a map or graphical representation of the vehicle route. A symbol or alphanumerical character marks vehicle location. Vehicle speed is expressed graphically according to a specified legend by either coloring, shading or otherwise marking the location symbols or alphanumerical characters with the appropriate marking from the speed legend. A circle graphically represents the vehicle location for each vehicle log file entry and vehicle speed is represented by grayscale shading the corresponding location circle according to the "Speed in m.p.h." legend. Alternatively, several vehicles can be displayed in one vehicle track plot whereby each vehicle is identified by different marker morphologies.

In another specific embodiment of the present invention, a website can provide a central location for assisting with the distribution of information regarding vehicle operations wherein the website includes integrated informational screens displaying vehicle log files and vehicle track plots corresponding to individual vehicle route numbers and dates. Passengers and vehicle operators can access information included on the website to conveniently monitor vehicle activities. In addition, the website can also allow bus operators to provide passengers with estimated delay times for bus routes. The website is then linked to a toll-free number so users can easily access the information. This website function is particularly important when a receiver fails to go off in the expected time period for a bus pickup whereby the parents can call the toll-free number or access the website to investigate the delay.

A preferred embodiment of the invention involves the advanced notification of children and their parents of a school bus arriving at a bus stop. Bus operators commonly receive parental complaints regarding excessive bus speed. Previously, there was no means to routinely monitor bus speed to confirm or deny accusations of school buses being operated at excessive speed. With the use of accessible archived bus log files and bus track plots, bus operators, school administration staff or parents can readily monitor bus speed and travel patterns.

While such a preferred embodiment of the present invention involves the advanced notification of school bus arrival at a bus stop, this notification system has many other applications that include, but are not limited to the following examples. Notifying hospitals of an approaching ambulance carrying severe trauma patients that require immediate attention thereby minimizing inactive waiting periods in an ER. Emergency rescue situations wherein a disabled vehicle or individual activates a transmitter to assist search efforts by rescue parties. Parents can generate a car track plot of where a car equipped with a transmitter has been and at what speeds it was monitor the driving habits of their children. Rental car companies can equip their cars with transmitters to facilitate locating rental cars in parking lots and to provide advanced notification of a rental car return.

Other applications for this invention include any situation where point-to-point proximity information would be useful. By delivering proximity information in a cost effective manner by eliminating systems and infrastructure costs, many personal tracking application can be easily contemplated. Thus, these applications are in no way limited to mobile vehicles.

The features and principles of the present invention have been described relative a preferred embodiment thereof. It will be apparent to those skilled in the art that numerous variations or modifications may be made to the preferred embodiment without departing from the spirit of the present invention. Thus such variations and modifications are intended to be included herein within the scope of the present invention.

What is claimed is:

1. A vehicle notification system comprising:

at least one vehicles, a vehicle transmission apparatus on each of the at least one vehicle such that the vehicle transmission apparatus determines the vehicle location by GPS and broadcasts a radio frequency signal including vehicle identification information and vehicle location as determined by GPS;

wherein said transmission apparatus for each of the at least one vehicle comprises a central processing unit (CPU), a transmission module, a GPS device, and at least one antenna, where the GPS device calculates the vehicle location using a plurality of global positioning satellite signals, the CPU generates a signal comprising vehicle identification information and vehicle location and the transmission module emits a radio frequency signal comprising the CPU generated signal; and a plurality of receiving units, each of said plurality of receiving units being capable of providing a notification that a specified vehicle is approaching a given location along a route for the specified vehicle, said each of the plurality of receiving units comprising a receiver module, and a CPU, wherein said receiving unit receives a RF signal, identifies the RP signal that corresponds to that being transmitted by the transmission apparatus for the specified vehicle, calculates the distance between the receiving unit and the specified vehicle with GPS determined locations included with the received RF signal from the specified vehicle and provides one of a distance indication or an alert signal as the notification of arrival of the specified vehicle, the distance indication being representative of the calculated distance and the alert signal is provided when the calculated distance is less than a threshold distance.

2. A vehicle notification system comprising:

at least one vehicle a vehicle transmission apparatus on each of the at least one vehicle such that the vehicle transmission apparatus determines the vehicle location by GPS and broadcasts a radio frequency signal including vehicle identification information and vehicle location;

wherein said transmission apparatus for each of the at least one vehicle comprises a central processing unit (CPU), a transmission module, a GPS device, and at least one antenna, wherein the GPS device calculates the vehicle location using a plurality of global positioning satellite signals, the CPU generates a signal including vehicle identification information and vehicle location, and the transmission module emits a radio frequency signal comprising the CPU generated signal; and a plurality or receiving units, each of said plurality of receiving units being capable of providing a notification that a specified vehicle is approaching a given location along a route of the specified vehicle and comprises a receiver module, a CPU, and a historical log file being accessible to the CPU, wherein said receiving unit receives a RF signal, identifies the RF signal that corresponds to that being transmitted by the transmission apparatus for the specified vehicle, determines the vehicle arrival time by comparing the current vehicle position with the historical log tile and provides one of an indication of the determined arrival time or an alert signal as the notification of arrival of the specified vehicle and the alert signal is provided when the determined time to vehicle arrival is less than a threshold time.

3. A system as in either claim 1 or 2 wherein the transmission apparatus broadcasts a RF signal using Spread Spectrum channel hopping technology and receiving units receive Spread Spectrum RF signals from the transmission apparatus by intelligently channel hopping.

4. A system as in any of claims 1 or 2 wherein the vehicle is a school bus.

5. A system as in claim 1 wherein the GPS device of said vehicle transmission apparatus for each of the at least one vehicle further determines the direction of vehicle travel, wherein the signal generated by the transmission apparatus CPU and broadcasted by the vehicle transmission apparatus transmission module further includes the direction of vehicle travel and wherein said receiving unit further compares the transmitted direction of vehicle travel for the specified vehicle with a stored direction of vehicle travel such that when the transmitted and stored directions of vehicle travel match said receiving unit provides the alert signal.

6. A system as in claim 2 wherein the GPS device of the vehicle transmission apparatus of the at least one vehicle further determines the direction of vehicle travel, wherein the signal generated by the transmission apparatus CPU and broadcasted by the vehicle transmission apparatus transmission module further includes a direction of vehicle travel, wherein the receiving unit compares the vehicle location and direction travel for the specified vehicle with the stored historical log file to determine the time to vehicle arrival and to determine if the transmitted direction of vehicle travel for the specified vehicle matches a stored direction of vehicle travel, and wherein the alert signal is provided when the determined arrival time is less than a threshold time and the transmitted and stored directions of vehicle travel match.

7. A system as in any of claims 1–2 wherein said vehicle transmission apparatus for each of the at least one vehicle further comprises a transmitter pendant, wherein:

said vehicle transmission apparatus is programmed by input entered in the transmitter pendant; and the transmitter pendant comprises an interface to transfer information with a vehicle transmission apparatus, at least one display and at least one input device to change vehicle identification information stored in the transmission apparatus memory means.

8. A system as in any of claims 1–2 wherein transmission apparatus for each of the at least one vehicle further comprises a GPS device that further determines vehicle speed and a CPU with the means to create a vehicle log file wherein each entry in the vehicle log file comprises the time and vehicle information including location and speed and the system has the means to transfer the contents of at least one vehicle log file to a PC.

9. A system as in claim 8 wherein the vehicle log file is downloaded to a PC which comprises the means to generate a vehicle track plot from the information included in the downloaded vehicle log file.

10. A system as in claim 9 wherein a website comprising vehicle information is available to passengers to monitor vehicle activities wherein the vehicle information can include any of the following information vehicle log files, vehicle track plots and estimated vehicle delay times for a plurality of vehicles.

11. A system as in of any of claims 1–2 wherein said receiving unit further includes a learning protocol for execution in the CPU of the receiving unit the learning protocol including instructions for acquiring vehicle location information being transmitted by the specified vehicle, said learn protocol for teaching the receiving unit certain information for the receiving unit to use during its operation; and a mechanism operably coupled to the CPU for actuation and de-actuation of the learning protocol.

12. A system as in claim 11, wherein the learning protocol includes instructions to acquire location information being transmitted with the strongest RF signal and to store this information in a receiving unit memory when the mechanism actuates the learning protocol.

13. A system as in claim 11, wherein the learning protocol includes instructions to acquire vehicle location and identification information being transmitted by the specified vehicle and to store this information in a receiving unit memory when the mechanism actuates the learning protocol.

14. A system as in claim 11, wherein the learning protocol includes instructions to acquire vehicle location, vehicle identification information and vehicle direction of travel information being transmitted by the specified vehicle and to store this information in a receiving unit memory when the mechanism actuates the learning protocol.

15. A system as in claim 11, wherein the learning protocol includes instructions to acquire vehicle location and vehicle direction of travel information being transmitted by the specified vehicle and to store this information in a receiving unit memory means when the mechanism actuates the learning protocol.

16. A system as in any of claims 1–2 wherein said system further comprises:

a plurality of vehicles; and a plurality of vehicle transmission apparatuses, one for each vehicle.

17. A system as in any of claims 1–2 wherein there are a plurality of given locations along the travel route of the specified vehicle and wherein said system further comprises:

a plurality of vehicles;

a plurality of vehicle transmission apparatuses, one for each vehicle; and wherein at least one receiving unit is located at each of the plurality of given locations.

18. The system of claim 1, wherein each of said plurality of receiving units includes an alert mechanism that is activated to provide the alert signal when the CPU determines that the calculated distance is less than the threshold value.

19. The system of claim 2, wherein each of said plurality of receiving units includes an alert mechanism that is activated to provide the alert signal when the CPU determines that the determined vehicle arrival time is less than the threshold value.

20. A method for teaching a receiving unit located in proximity to a given location along a route for a specified vehicle and being provided to give advance notification of arrival of the specified vehicle, said receiving unit comprising a receiver module, a CPU, and a memory means, wherein said receiving unit receives a RF signal, identifies the RF signal that corresponds to that being transmitted from the specified vehicle, and determines the vehicle arrival time; the teaching method comprising the steps of:

activating a receiving unit learn function protocol as the specified vehicle approaches the given location, said learn function protocol for teaching the receiving unit certain information for use by the receiving unit to provide advance notification of arrival of the specified vehicle at the given location;

monitoring the RF signal with the greatest amplitude; and capturing the vehicle identification information and vehicle location being received and storing the vehicle location in the receiving unit memory as the location of the receiving unit when the signal amplitude of the RF signal is maximized.

21. A method for teaching a receiver unit located in proximity to a given location along a route for a specified vehicle and being provided to give advance notification of arrival of the specified vehicle, said receiving unit comprising a receiver module, a CPU, a memory means, a historical log file stored in the memory means and an alert mechanism wherein said receiving unit receives a RF signal, identifies the RF signal that corresponds to that being transmitted from the specified vehicle, determines the vehicle arrival time by comparing the transmitted current vehicle position with the historical log file, compares a direction of travel being transmitted from the specified vehicle with a stored direction of vehicle travel, and activates the alert mechanism when the calculated time to vehicle arrival is less than a threshold time and when the transmitted and stored directions of vehicle travel match, the method comprising the steps of:

activating a receiving unit learn function protocol as the specified vehicle approaches the given location, said learn function protocol for teaching the receiving unit certain information for use by the receiving unit to provide advance notification of arrival of the specified vehicle;

monitoring for the RF signal with the greatest amplitude; and capturing the vehicle identification information and storing the captured vehicle log file in the receiving unit memory means as the historical log file when the signal amplitude being monitored is determined to be maximized.

22. A method of calculating the time to vehicle arrival at a specified point along the route of a vehicle wherein the method comprises:

locating a receiving unit in proximity to the specified point;

receiving a vehicle location from the vehicle using the receiving unit, matching the received location to the location parameter of a log file entry in a stored log file of the receiving unit, calculating the time to arrival in the receiving unit, wherein the time in the matching log file entry is subtracted from the time corresponding to the vehicle arriving at the specified point on the vehicle route, comparing the calculated time to a threshold time value, and alerting a user if the calculated time is less than the threshold value.

23. A method for teaching a receiving unit as in claim 20, wherein the receiving unit further compares a direction of travel being transmitted from the specified vehicle with a stored direction of vehicle travel such that when the transmitted and stored directions of vehicle travel match said receiving unit generates an alert signal as advance notification of vehicle arrival, said method comprising the steps of:

activating a receiving unit learn function protocol as the specified vehicle approaches the location for passenger pickup;

monitoring for the RF signal with the greatest amplitude; and capturing the direction of vehicle travel for the specified vehicle and storing the direction of travel along with the vehicle location information being stored in the receiving unit memory.

24. A method as in any of claims 20, 23, or 21 further comprising the step of:

deactivating said learn function protocol after said step of capturing and storing.

25. A method as in claim 22 wherein the method further comprises matching the received vehicle location and direction of vehicle travel to the location and direction of travel parameters of a log file entry in a stored log file in the receiving unit before calculating the time to vehicle arrival.

26. A method as in any of claims 22 or 25 further comprising the step of activating a learn function protocol as the vehicle approaches the specified point to acquire vehicle location information of the approaching vehicle, said learn function protocol for teaching the receiving unit certain information for use by the receiving unit.

27. A method as in any of claims 22 or 25 further comprising the steps of:

activating a learn function protocol as the vehicle approaches the specified point, said learn function protocol for teaching the receiving unit certain information for use by the receiving unit;

capturing vehicle location information being transmitted from the approaching vehicle, and storing the last transmitted vehicle location as the receiver location.

28. A method as in claim 26 further comprising the step of:

deactivating said learn function protocol after the vehicle has stopped at the specified point.

29. A method as in claims 27 further comprising the step of:

deactivating said learn function protocol after the vehicle has stopped at the specified point.

30. A method for teaching a receiving unit located in proximity to a given location along a route for a specified vehicle and being provided lo give advance notification of arrival of the specified vehicle, said receiving unit comprising a receiver module, a CPU and a memory means, wherein said receiving unit receives a RF signal, identifies the RF signal that corresponds to that being transmitted from the specified vehicle, determines the vehicle arrival time, and provides one of an indication of the determined arrival time or an alert signal as advance notification of vehicle arrival; the method comprising the steps of:

activating a learn function protocol as the specified vehicle approaches the given location whereby the receiving unit captures the approaching vehicle identification information, said learn function protocol for teaching the receiving unit certain information for use by the receiving unit to provide advance notification of arrival of the specified vehicle, and deactivating said learn function protocol after the specified vehicle has stopped at the given location, whereby said receiving unit stores the last transmitted vehicle location in memory as the receiver location.

31. The teaching method of any of claims 20, 23, or 30 wherein the receiving unit further includes an alert mechanism that is activated to provide the alert signal when the determined vehicle arrival time is less than the threshold value.

32. A method for teaching a receiving unit located in proximity to a given location along a route for a specified vehicle and being provided to give advance notification of arrival of the specified vehicle, said receiving unit comprising a receiver module, a CPU, a memory means, a historical log file stored in the memory means and an alert mechanism wherein said receiving unit receives a RF signal, identifies the RF signal that corresponds to that being transmitted from the specified vehicle, determines the vehicle arrival time by comparing the transmitted current vehicle position with the historical log file, compares a direction of travel being transmitted from the specified vehicle with a stored direction of vehicle travel, and activates the alert mechanism wherein the calculated time to vehicle arrival is less than a threshold time and when the transmitted and stored directions of vehicle travel match, the method comprising the steps of:

activating a learn function protocol as the vehicle for which notification is desired approaches the given location, whereby the receiver captures the approaching vehicle identification information, said learn function protocol for teaching the receiving unit certain information for use by the receiving unit to provide advance notification of arrival of the specified vehicle, and deactivating said learn function protocol after the specified vehicle has stopped whereby the receiving unit stores the last transmitted vehicle position such that the captured vehicle position is stored in receiving unit memory means as the historical log file.

* * * * *